US008116950B2

(12) United States Patent
Glee

(10) Patent No.: US 8,116,950 B2
(45) Date of Patent: Feb. 14, 2012

(54) MACHINE SYSTEM AND OPERATING METHOD FOR COMPACTING A WORK AREA

(75) Inventor: Katherine C. Glee, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 598 days.

(21) Appl. No.: 12/287,239

(22) Filed: Oct. 7, 2008

(65) Prior Publication Data

US 2010/0087992 A1 Apr. 8, 2010

(51) Int. Cl.
*G06F 7/70* (2006.01)

(52) U.S. Cl. ..... 701/50; 405/271; 404/75; 404/76; 702/137

(58) Field of Classification Search ..... 701/50; 405/271; 404/75, 76; 702/137
See application file for complete search history.

(56) References Cited

U.S. PATENT DOCUMENTS

| | | | | |
|---|---|---|---|---|
| 4,127,351 | A | 11/1978 | Vural | |
| 4,348,901 | A | 9/1982 | Vural et al. | |
| 5,471,391 | A * | 11/1995 | Gudat et al. | 701/50 |
| 5,493,494 | A | 2/1996 | Henderson | |
| 5,727,900 | A | 3/1998 | Sandstrom | |
| 6,004,076 | A | 12/1999 | Cook et al. | |
| 6,122,601 | A | 9/2000 | Swanson et al. | |
| 6,188,942 | B1 * | 2/2001 | Corcoran et al. | 701/50 |
| 6,460,006 | B1 | 10/2002 | Corcoran | |
| 6,973,821 | B2 | 12/2005 | Corcoran | |
| 7,191,062 | B2 | 3/2007 | Chi et al. | |
| 7,731,450 | B2 * | 6/2010 | Congdon et al. | 404/84.5 |
| 2007/0150147 | A1 * | 6/2007 | Rasmussen et al. | 701/50 |
| 2007/0239336 | A1 | 10/2007 | Congdon et al. | |
| 2007/0239338 | A1 * | 10/2007 | Potts et al. | 701/50 |
| 2008/0063473 | A1 * | 3/2008 | Congdon et al. | 404/75 |
| 2008/0267719 | A1 * | 10/2008 | Corcoran | 405/271 |

* cited by examiner

*Primary Examiner* — Michael Carone
*Assistant Examiner* — Samir Abdosh
(74) *Attorney, Agent, or Firm* — Liell & McNeil

(57) ABSTRACT

A machine system includes a compactor having a frame, at least one compacting element coupled with the frame, and a sensing system configured to output signals including electronic data indicative of a varying response of material within a work area to interaction of the compactor therewith. The machine system further includes an electronic control unit coupled with the sensing system and configured to link the electronic data with location data for the work area, and further configured to assign each one of at least two different compaction targets to different regions of the work area responsive to linking the electronic data with the location data. The machine system may further include a computer readable memory storing a compaction interaction planning algorithm, whereby the electronic control unit determines a compactor interaction plan for navigating the compactor within the work area.

20 Claims, 6 Drawing Sheets

MACHINE SYSTEM AND OPERATING METHOD FOR COMPACTING A WORK AREA

TECHNICAL FIELD

The present disclosure relates generally to systems and strategies for compaction of material, and relates more particularly to assigning different compaction targets to different regions of a work area based on a varying compaction response of material therein.

BACKGROUND

Many construction, road building and other activities utilize compactor machines to compact material such as soil, asphalt, etc. and increase the density of the material for load bearing purposes. Compaction is also used for reducing material volume, as in the case of landfill trash. Conventional wisdom is to pass a compactor uniformly across a work area until the work material has been increased in density to a sufficient degree. While a uniform coverage approach is simple and straightforward, it has certain drawbacks.

Material within different regions of a work area will often tend to compact non-uniformly. In other words, for a given number of passes with a compactor there may be variation in the relative increase in density of the material among different regions of a work area. As a result, where uniform coverage is used certain areas may be under-compacted, certain areas may be over-compacted or the project may require an excessive amount of time. Expenses associated with operating construction machinery such as compactors can therefore often be high due to wasted effort by the compactor machine and necessary remediation where compaction does not occur as intended. In recent years, a variety of strategies have been proposed for improving compactor efficiency, such as systems which measure the density of compacted material and other strategies where the response of material to compaction in real time is monitored. While certain of these techniques have shown promise, there remains room for improvement.

It is common at construction sites for compaction specifications to be provided to a construction manager or contractor. In particular, a relative compaction state or minimum compaction value, minimum number of compactor passes, and other factors may be specified. There may be a number of different ways in which a work area can be compacted to satisfy the compaction specifications. For example, the entire work area might be compacted to within 90% of a specified minimum compaction value. Alternatively, a portion of the work area could be compacted to 100% of the specified minimum compaction value, whereas another portion might be compacted to a lesser degree of compaction. Still other combinations of compaction minimum value, compactor coverage, etc., can be imagined, and to a certain extent the manner in which specifications are met may be based on agreements between the contractor and the client. Department of Transportation agencies also commonly specify certain compaction state and/or compactor coverage requirements.

As mentioned above, improved sensing and control strategies have been proposed for operating compaction machinery in recent years, but still exhibit certain shortcomings. One problem in particular is that known systems often do not take into account the possibility of meeting compaction specifications by selecting one of multiple possible ways in which a machine system can be operated or navigated to compact a work area. In other words, while known systems might allow compaction of a work area to satisfy specifications more efficiently than relying simply on uniform coverage or operator judgment, these known strategies do not actually provide for calculation or estimation of the most efficient way to do so. Commonly owned U.S. patent application Ser. No. 11/517,065 to Congdon et al, filed Sep. 7, 2006, for example, discloses a concept where aberrant compaction response of a material is detected. The strategy of Congdon et al. promises significant efficiency improvements, as fruitless work on aberrantly responding material is avoided, but is not specifically directed to compacting non-aberrant material in an efficient manner.

The present disclosure is directed to one or more of the problems or shortcomings set forth above.

SUMMARY

In one aspect, a method of operating a machine system for compacting a work area includes a step of receiving electronic data indicative of a varying compaction response of material within a work area, and a step of linking the electronic data with location data for the work area. The method further includes a step of assigning each one of at least two different compaction targets to a different region of the work area, in response to linking the electronic data with location data.

In another aspect, a machine system includes a compactor having a frame and at least one compacting element coupled with the frame, and a sensing system configured to output signals including electronic data indicative of a varying response of material within a work area to interaction of the compactor therewith. The machine system further includes an electronic control unit coupled with the sensing system and configured to link the electronic data with location data for the work area, the electronic control unit being further configured to assign each one of at least two different compaction targets to different regions of the work area responsive to linking the electronic data with the location data.

In still another aspect, a machine control system includes an electronic control unit configured to receive signals including electronic data indicative of a varying response of material within a work area to interaction of a compactor therewith, the electronic control unit being further configured to receive location data for the work area and to link the electronic data with the location data and responsively assign each one of at least two different compaction targets to different regions of the work area.

DETAILED DESCRIPTION

Figure 1:
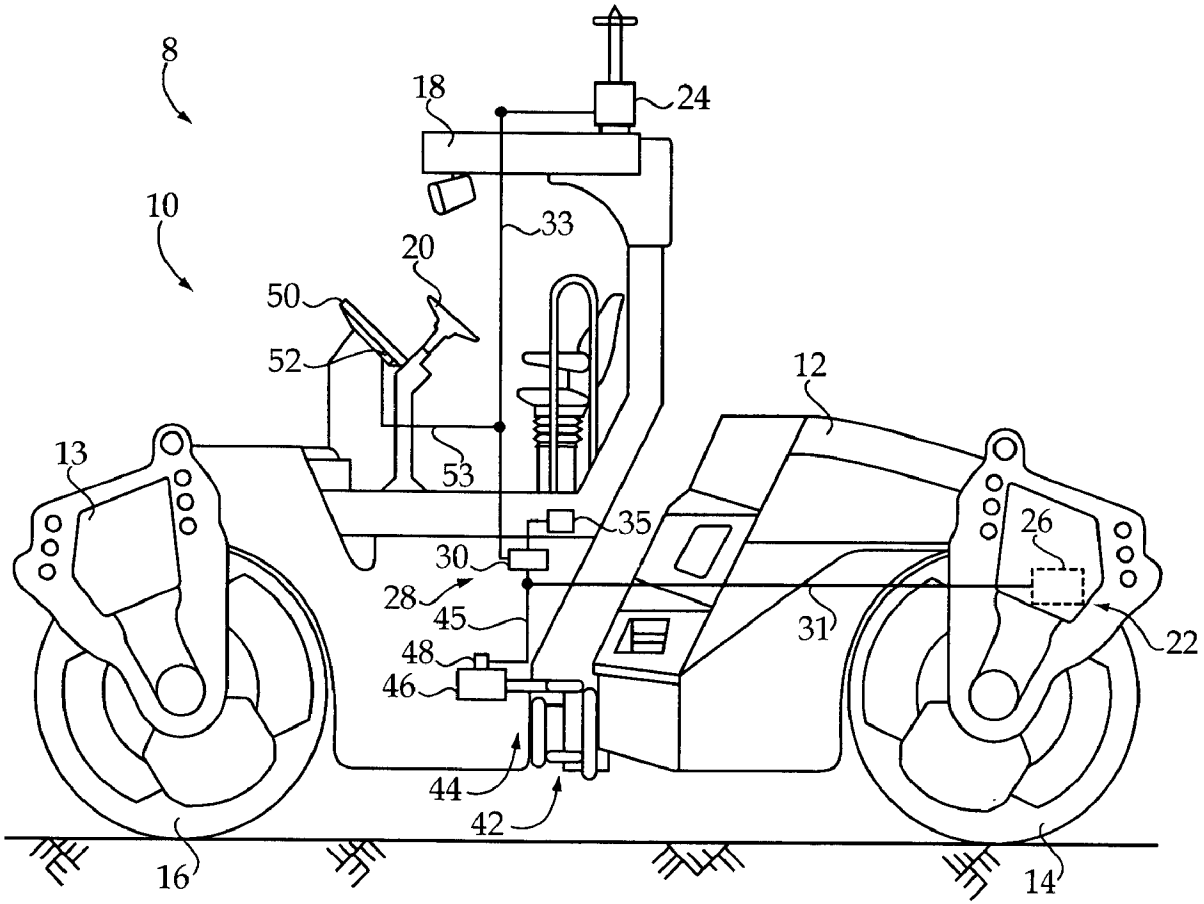
FIG. 1 is a side diagrammatic view of a machine system according to one embodiment.

Referring to FIG. 1, there is shown a machine system 8 for use in compacting a work area. Machine system 8 may include a compactor 10 having a frame with a front frame unit 13 and a back frame unit 12. Compactor 10 may further include an operator cab 18 having therein an operator input device such as a steering wheel 20 or similar control device for controlling a travel direction of compactor 10. A position or location signal receiver 24 may be mounted on one of frame units 12 and 13, and configured to receive position signals from a signal transmitter such as a global positioning satellite(s), or another system such as a ground based laser positioning system. Compactor 10 may further include a control system 28 configured to control various aspects of compactor operation, further described herein. Compactor 10 may also include a sensing system 22 having at least one sensor 26 configured to output sensor data signals or "sensor data" indicative of a compaction response of a material with which compactor 10 is interacting, also further described herein. Control system 28 may further include an electronic control unit 30 which receives data inputs from sensing system 22 and utilizes the data inputs to plan or control compactor navigation within a work area to enable operation of machine system 8 in an efficient manner, as will be further apparent from the following description.

Sensing system 22 may be in communication with electronic control unit 30 via a communication line 31. Receiver 24 may communicate with electronic control unit 30 via another communication line 33. A display 50 including an input device 52 mounted thereon or integral therewith, or positioned separately from display 50, may be located at operator cab 18 and coupled with electronic control unit 30 via yet another communication line 53. In one embodiment, compactor 10 may include a steering system 44 having at least one actuator 46 such as a hydraulic actuator controlled via a control valve 48, and configured to adjust an articulation angle between front frame unit 13 and back frame unit 12 at an articulation joint 42. Compactor 10 is shown in the context of a double drum compactor having a front compacting drum 16 mounted to front frame unit 13, and a back compacting drum 14 mounted to back frame unit 12, however, it should be appreciated that other embodiments are contemplated wherein compactor 10 includes only one compacting drum, such as a front compacting drum and includes tires in place of a back compacting drum. In still other embodiments, rather than conventional compacting drums, pad foot or sheep's foot style compacting elements might be used, such as for a landfill trash compactor. Multiple front drums and/or multiple back drums may also be used. Steering/travel direction of compactor 10 may be controlled via an operator manipulating steering wheel 20. In other embodiments, compactor 10 might be an autonomous machine where electronic control unit 30 is configured via software and/or hardware control to operate steering system 44 via computer generated control signals. Another communication line 45 connects electronic control unit 30 with control valve 48, or an actuator thereof. Other manual or automated features such as a vibratory apparatus (not shown) might be associated with one or both of front and back drums 16 and 14. It should further be appreciated that, while communications between and among components of compactor 10 are described as utilizing communication "lines," wireless communication might be used. Further, compactor 10 could communicate wirelessly with a control station or the like, and control system 28 might be positioned remotely in some embodiments.

As mentioned above, sensor 26 may be configured to sense values indicative of a compaction response of material with which compactor 10 interacts. In other words, sensor 26 may be configured to monitor a parameter during operating compactor 10 which is indicative of a change or lack of change in relative compaction of a material such as soil, gravel, concrete, asphalt, landfill trash and mixtures thereof, etc., as compactor 10 is moved over the material within a work area. Sensor 26 may be a single sensor, or a set of sensors, configured to sense a relative rolling resistance of compactor 10 as it moves within a work area. Rolling resistance sensed via sensor 26 may indicate relative compaction of material across which compactor 10 is moved. A change in rolling resistance from one compactor pass to another can be used to calculate, estimate or infer a compaction response of material. Changes in another compaction parameter such as density may also be understood to define a compaction response of material with which compactor 10 interacts. The present disclosure should be understood as contemplating any known means for determining a compaction state of material with which compactor 10 interacts, or a change in compaction state from one pass via compactor 10 to another. In the embodiment shown, sensing system 22, position signal receiver 24 and control system 28, as well as display 50 and input device 52 are all resident on compactor 10. It should be appreciated, however, that in other embodiments certain or all of these components/systems might be located remotely from compactor 10. For instance, electronic control unit 30 might be located at a work site management center or control station, and receiver 24 and sensing system 22 located on an autonomous drone in wireless communication with electronic control unit 30.

Sensing relative rolling resistance may be a practical implementation strategy for determining an energy transfer between compactor 10 and the material being compacted. Energy transfer has been shown to relate to a change in relative compaction when material is worked via compactor 10, which in turn indicates the material's compaction response. In one embodiment, electronic control unit 30 may be coupled with a computer readable memory 35, and may include a memory writing device configured to record rolling resistance data or other compaction response related data thereon, as compactor 10 is passed across a given region of a work area. For example, gross driveline energy output of compactor 10 may be determined, internal losses of compactor 10 subtracted, and the portion of energy expended that relates to an inclination of the surface in a particular region of interest also subtracted. This calculation will allow a determination of the net energy expended to compact material during a measured time or travel distance of compactor 10. This data is otherwise known as "net compaction energy." Net compaction energy is indicative of work material compaction response, in particular net compaction energy is negatively correlated with compaction response. Thus, as used herein "indicative of" should not be construed to necessarily mean proportional to or positively correlated with, etc. These data may be recorded on memory 35 for reference in planning subsequent compactor interaction. A suitable apparatus and method for the process of determining rolling resistance of compactor 10 in this general manner, and hence net compaction energy is taught in U.S. Pat. No. 6,188,942 to Corcoran et al. By tracking machine position via the receipt of position signals with receiver 24, electronic control unit 30 can link compaction response data with position or location data for a work area to allow a varying compaction response of material within a work area to be mapped. Various other means exist for directly or indirectly determining net compaction energy imparted to material via compactor 10. Certain of these means are identified in copending and commonly owned U.S. patent application Ser. No. 11/517,065, filed Sep. 7, 2006.

As mentioned above, machine system 8 may be operated to compact material within a work area in an efficient manner. It is contemplated that machine system 8 may be used such that compaction specifications are met by way of fewer passes via compactor 10, and in less time than state of the art designs. To this end, control system 28 may be uniquely configured via software and/or hardware control to plan and optionally control operation of compactor 10, and potentially other machines (not shown) of machine system 8, for compacting a particular work area to specifications. Computer readable memory 35 may store a compactor interaction planning algorithm for controlling various aspects of interaction between compactor 10 and material within a work area. The planning algorithm may include computer executable code, and electronic control unit 30 may execute the planning algorithm via executing the computer executable code. The term "interaction" as used herein in connection with compactor 10 and material within a work area should be understood to include such factors as compactor speed, compactor travel direction, vibratory output state where vibratory apparatuses are used, number of compactor passes over a particular work area, and still other factors such as orientation of compactor drums 16 and 14 relative to surface features such as seams between different types or grades of material. Electronic control unit 30 may be configured in particular via executing the compactor interaction planning algorithm to determine a compactor interaction plan for compacting a work area. In one embodiment, display 50 is controllably coupled with electronic control unit 30 and is configured to display a map of a work area, and also configured to display at least one of, a compactor coverage of the work area, a compaction response of material within the work area and a compactor interaction plan such as a planned compactor travel path for moving compactor 10 within the work area. Computer readable memory 35, which may include RAM, ROM, flash memory or any other type of computer readable memory, may also be configured to store compaction specification criteria thereon, the significance of which will be apparent from the following description. In one embodiment, input device 52 may be used for inputting compaction specification criteria which are recorded on computer readable memory 35 via electronic control unit 30.

The operating and compactor interaction planning capabilities of machine system 8 are made possible in part via the unique software and hardware elements of compactor 10, and in particular control system 28 and sensing system 22. In one embodiment, operating machine system 8 according to the present disclosure may include receiving electronic data indicative of a varying compaction response of material within a work area. In other words, electronic data may be received by electronic control unit 30, for example via sensing system 22, which is indicative of a compaction response of material in each of a plurality of different regions of the work area, the compaction response exhibiting variation among the different regions. Operating machine system 8 may further include linking the electronic data with location data for the work area. For example, position signals received via receiver 24 may be associated with the electronic data indicative of compaction response, allowing determination of compaction response or trends in compaction response for each of a plurality of different regions of the work area. In response to linking the electronic data with location data, electronic control unit 30 may assign each one of at least two different compaction targets to different regions of the work area, as further described herein.

As alluded to above, in certain instances there may be more than one way to satisfy compaction specifications. For example, compaction specifications might be met by compacting an entire work area to a uniform compaction state which is considered to be an acceptable compaction state based on a predefined compaction state specification. In other instances, compaction specifications might be satisfied by compacting a certain percentage of a work area to a relatively higher compaction state, while compacting another percentage of the work area to a relatively lower compaction state. Those skilled in the art will appreciate that a number of different plans might be established for compacting a particular work area to a state satisfying compaction specifications. Known strategies, however, by and large assume that material will respond uniformly to compactor interaction. Strategies which recognize variation in compaction response typically provide an operator or controller only with information relevant to compaction progress or identification of fault conditions. The present disclosure recognizes that multiple avenues may exist which each lead to satisfaction of compaction specifications, and enables selection of the most efficient one. By "efficient," it is meant that the operation of compactor 10 may be planned and/or controlled such that wasted effort compacting material which responds less favorably or more slowly is avoided, whereas material responding more favorably or more rapidly is preferentially worked. Fewer passes via compactor 10, reduced fuel consumption, reduced operator work time and other improvements may be realized by implementing the teachings set forth herein. These aspects and improvements will be more readily apparent by way of the following description of a hypothetical compaction process.

Figure 2:
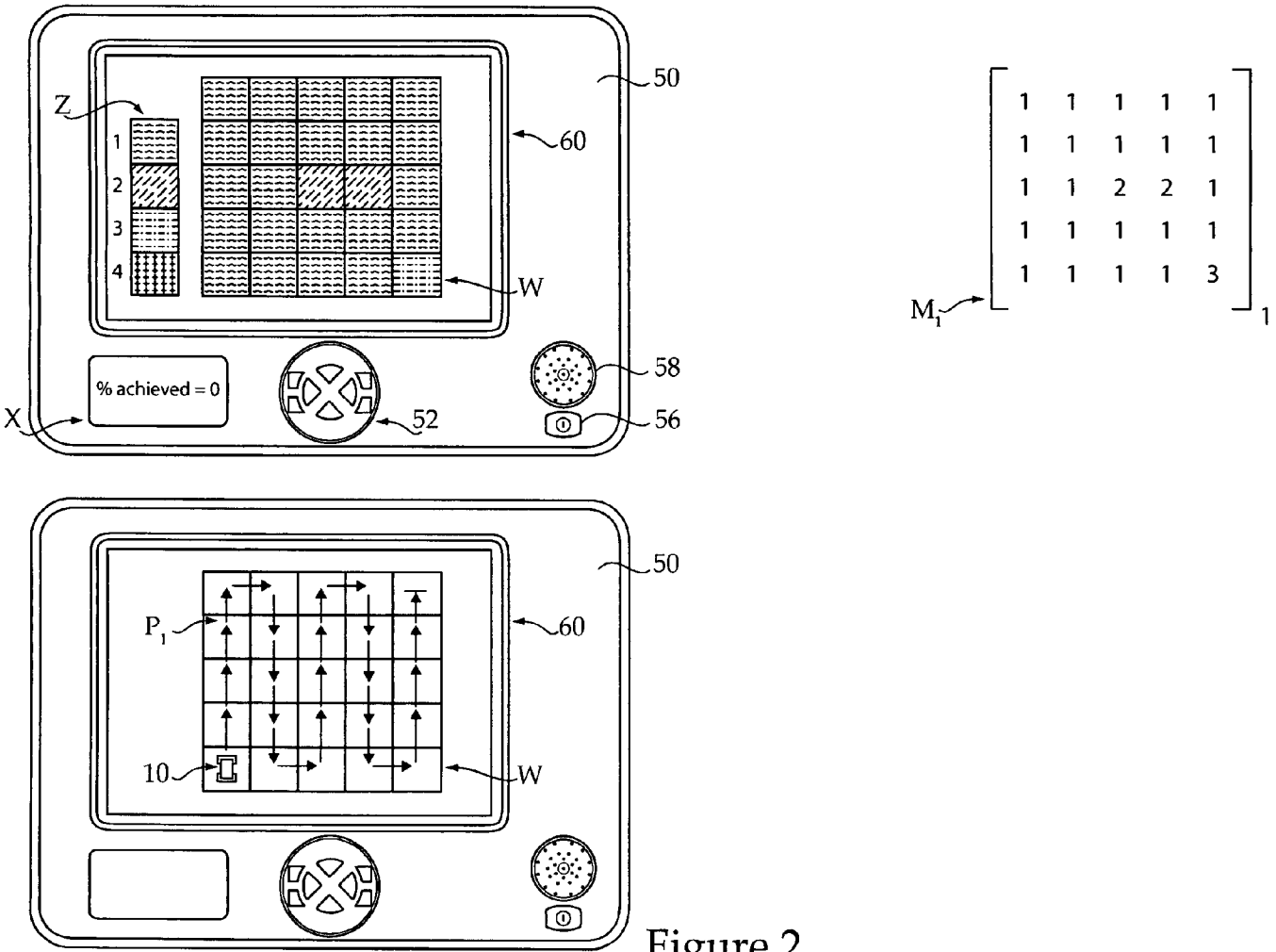
FIG. 2 is a hypothetical data display scenario using a display of the machine system of FIG. 1.

Referring to FIG. 2, there is shown display 50 in two different display states, one in the upper portion of FIG. 2, and one in the lower portion of FIG. 2. A matrix $M_1$ to be described later is also shown. Display 50 may include a display screen 60 which is configured to display in an operator perceptible format various types of information about a particular work area, the work area being represented in FIG. 2 via reference letter W. A scale Z is shown displayed on display screen 60, including different display graphics or colors corresponding to a numerical scale from 1 to 4. In the illustrated embodiment, the numerical scale corresponds to an increasing relative compaction state from number 1 to number 4. Display 50 may also include input device 52, for example including control buttons, a power on/off switch 56 and a speaker 58 for communicating audible signals to an operator.

In the display state shown in the upper portion of FIG. 2, relative compaction state for each of a plurality of different regions of the work area is shown after one or more preliminary passes with compactor 10. Thus, in FIG. 2, compactor 10 has compacted or attempted to compact the entire work area W at least once. It will be recalled that electronic control unit 30 may be configured to link location data for the work area with electronic data indicative of the varying compaction response of material within a work area. In the example shown in FIG. 2, the work area W is partitioned into twenty-five different cells, each having a graphic display state corresponding to a compaction state on scale Z. Greater or fewer cells could be used, in other embodiments. It may be noted that different regions of the work area, corresponding to different cells, are responding differently to compactor interaction therewith, illustrating a varying compaction response. Display 50 may include another display screen or the like, shown via reference letter X, where a percent goal achieved is shown. In other words, display screen X may be used to display to an operator what percentage of the work area has been compacted to a specified compaction state.

The illustration of display 50 shown in the lower portion of FIG. 2 includes a compactor travel path $P_1$ through each of the cells of the work area. According to the planned travel path $P_1$ compactor 10, shown as an icon on display screen 60, is to pass across work area W uniformly. In general, operation of machine system 8 according to the present disclosure will commence with at least one, and typically two or three, passes over a work area in a uniform manner to ensure that every region of the work area is compacted at least once. Thus, execution of the compactor interaction planning algorithm via electronic control unit 30 will typically establish a uniform coverage plan or compactor travel plan within work area W for preliminary passes. As further described herein, however, once additional compaction response data is gathered, more complex and non-uniform compactor interaction plans will be established. Stated another way, the compactor interaction plan will be updated in response to additional compaction response data. Also shown in FIG. 2 is example matrix $M_1$, wherein a numerical value is assigned to each of the cells of work area W. Electronic control unit 30 may track compaction progress in each of the cells via matrices. Thus, the leftmost numeral 1 in the top row of matrix $M_1$ corresponds to the leftmost cell in the top row of the display map of work area W, and so on.

Figure 3:
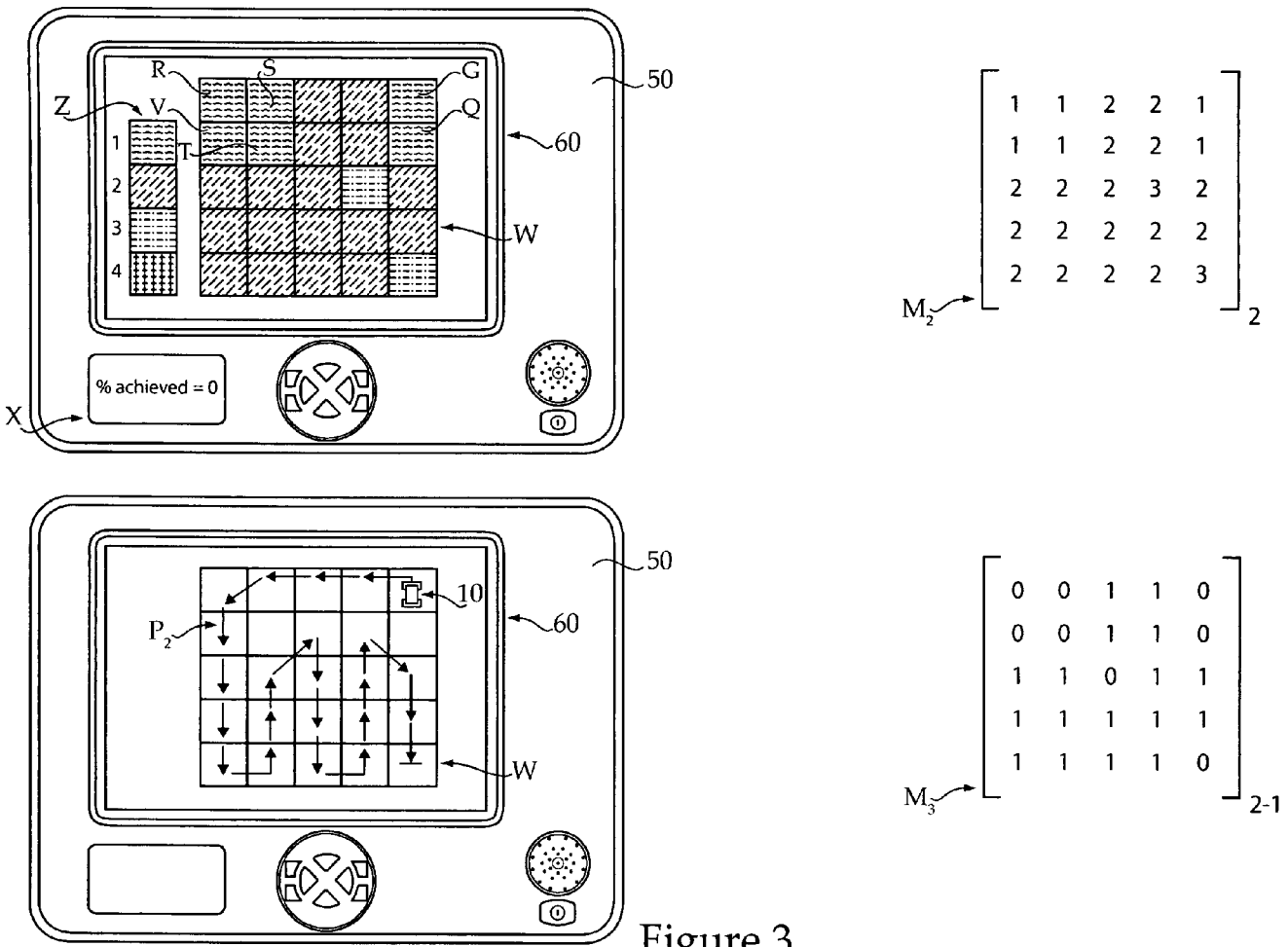
FIG. 3 is another hypothetical data display scenario using a display of the machine system of FIG. 1.

Referring also to FIG. 3, there is shown a similar illustration of display 50 in another display state, where relative compaction data is displayed graphically for each of the cells of work area W, and yet another display state showing a planned compactor travel path $P_2$ within work area W. The display state depicted in the upper portion of FIG. 3 corresponds to a hypothetical compaction state of material within each of the cells of work area W after a compactor pass following travel path $P_1$. It will be noted that the percent achieved remains at zero, as shown in display X. A second matrix $M_2$ is also shown where numerical values corresponding to the updated compaction state of material within each of the cells are tracked via electronic control unit 30.

It will be recalled that electronic control unit 30 will assign different compaction targets to different regions of work area W. It may also be noted that certain cells within work area W changed little, if at all, in relative compaction state after moving compactor 10 along travel path $P_1$. These cells are labeled via reference letters G, Q, R, S, T and V in FIG. 3. Thus, at the stage depicted in FIG. 3 electronic control unit 30 may conclude that certain cells are responding poorly, if at all, to compactor interaction. Additional attempts to compact cells G, R, S, T or V may be considered fruitless or at least require more effort and time than is desirable. Assigning each one of the different compaction targets to different regions of the work area may include assigning at least one of a compactor coverage target and a relative compaction target to the different regions of the work area. In other words, in establishing a compactor interaction plan, electronic control unit 30 may decide via executing the compactor interaction planning algorithm to specify a certain compactor coverage for a given cell, a particular relative compaction for a given cell, or both.

In the hypothetical example depicted in FIG. 3, relative compaction targets are assigned. In particular, a relatively lower relative compaction target is assigned to cells G, Q, R, S, T and V. For example, a target compaction state of 1 might be assigned to each of these cells. Thus, electronic control unit 30 has determined that, at least at the present time, no additional attempt will be made to compact cells G, Q, R, S, T and V. The more promising cells, other than cells G, Q, R, S, T and V, might be assigned a compaction target of 4. In one specific example, assigning the compaction targets might include populating a table stored on memory 35 with location coordinates for each of the cells of work area W. In FIG. 3, a matrix $M_2$ is also shown which indicates relative compaction in each one of the cells of work area W. A third matrix $M_3$, illustrates a difference between matrix $M_1$ and matrix $M_2$. The values of matrix $M_1$ may be subtracted from the values of matrix $M_2$ to generate a numerical indication of compaction response in each of the cells of the work area. It may be noted that the values in $M_3$ which correspond to areas P, Q, R, S, T and V are zero, as these areas showed no recent improvement. Once numerical compaction response values are determined, compaction response coordinates for each of the cells may be entered in the table. Compaction targets could then be assigned and also entered into the table, and electronic control unit could process the information stored in the table to establish or update a compactor interaction plan.

In one embodiment, assigning the compaction targets may be based on the distribution of cells showing the most promise for reaching an optimal compaction state, such as a compaction state of 4 on scale Z. Assigning the compaction targets could additionally or alternatively be based on a distribution of cells showing the least promise for reaching an optimal compaction state. In other words, electronic control unit 30 may determine that compaction effort should be directed within work area W based not only on how favorably material in different cells is responding, but based also on the relative locations or proximity of favorably responding and/or unfavorably responding cells. It should be noted that larger numbers in matrix M indicate a relatively larger, more favorable compaction response, and relatively smaller numbers indicate a relatively lesser, less favorable compaction response. Cells responding favorably which are located relatively close together could be assigned a compaction target equal to the optimal compaction state 4, for example. Minimal time may be required to reach compaction specifications for material in those cells not only because they appear to be responding well, but also because they can be reached without having to drive compactor 10 across the entire work area. Likewise, favorably responding cells that are relatively far from other favorably responding cells might be assigned to a lower target compaction category, since moving compactor 10 between those cells would require too much time and/or waste effort passing through unfavorably responding cells to reach the favorably responding cells.

Once compaction targets are assigned, electronic control unit 30 may determine a compactor travel path based on the assigned compaction targets. For example, electronic control unit 30 could determine the shortest travel path which would allow compacting material in each of the cells assigned to a target compaction state of 4. Alternatively, determining a compactor travel path may include determining a travel path that would avoid each of the cells assigned to a lower target compaction state such as a target compaction state of 1. A more complex determination might also take place, considering additional factors such as number of times compactor 10 would be turned to execute a particular path, slope in the work area, relative soil moisture, or even mat temperature in the case of asphalt compaction.

It will be recalled that compaction specification data may be stored on memory 35. Assigning the different compaction targets may further include reading the stored compaction specification data. Electronic control unit 30 might read compaction specification data stating, for example, that at least 75% of a work area must be at a compaction state of 4, and no more than 10% may be at a compaction state lower than 3, and no more than 5% may be at a compaction state of 1 or lower. The compaction specification data might also specify, for example, that the entire region must be covered via compactor 10 at least once, at least 75% must be covered at least three times, and so on. These examples are of course purely illustrative. Another way to consider the data processing represented in FIG. 3 is that electronic control unit 30 is reading compaction specification data, receiving electronic data indicative of compaction response for the different cells, then prioritizing compactor interaction with areas that appear to be responding favorably so that compaction specifications may be satisfied as efficiently as possible. The present strategy thus leverages an allowable error rate, defined by the compaction specification data, to optimize efficiency by enabling electronic control unit 30 to proactively decide which cells can be left at a compaction state that is less than an optimal compaction state, and which cells can be quickly compacted to an optimal state. Electronic control unit 30 thus calculates a pattern for differentially compacting cells which satisfies compaction specifications for the overall work area W with as little effort as possible.

Figure 4:
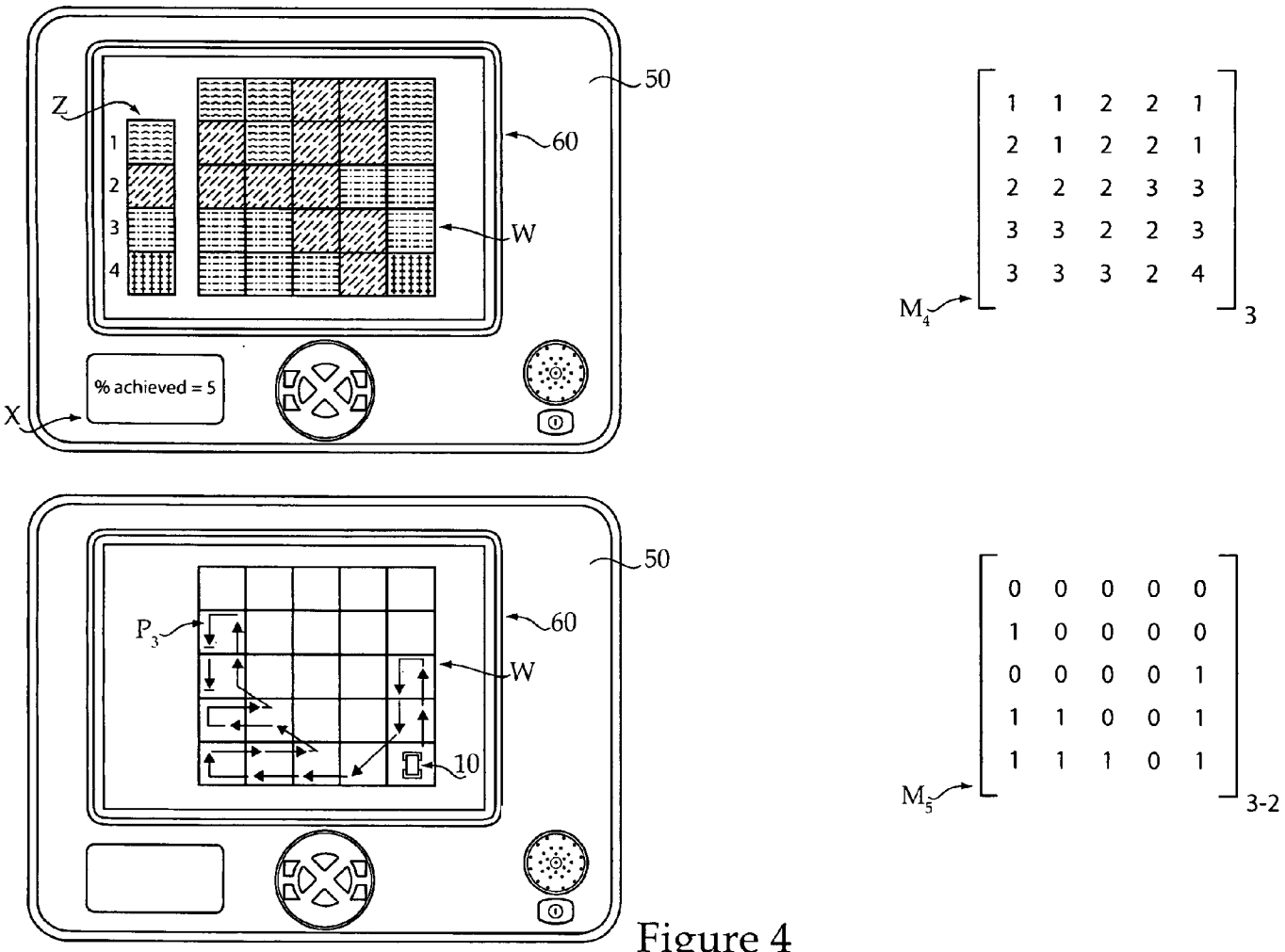
FIG. 4 is another hypothetical data display scenario using a display of the machine system shown in FIG. 1.

Referring also now to FIG. 4, there is shown display screen 60 as it might appear displaying a compaction state for each of the cells of work area W after a third compactor pass, according to compactor travel path $P_2$ shown in FIG. 3. A matrix $M_4$ is also shown in FIG. 4 which represents numerical values determined via electronic control unit 30 and indicating the relative compaction state of material in the individual cells of work area W. Also shown in FIG. 4 is another matrix $M_5$, representing the difference between the values in matrix $M_3$ and $M_2$. In the lower illustration of display 50 in FIG. 4 is yet another planned compactor travel path $P_3$. Compactor travel path $P_3$ may be established based on the additional compaction response/compaction state data received during the preceding compactor pass(es) according to travel path $P_2$. Thus, the compactor interaction plan may be updated after successive passes by way of travel path $P_2$ through selected cells of work area W.

It may be appreciated that the compaction state/response data tracked via electronic control unit 30, as represented in matrices $M_{1-5}$, can change over time. Thus, areas which might initially be thought to be responding well may turn out later to respond relatively poorly, and vice versa. Thus, preliminary response data associated with one or more preliminary compactor passes within each of the cells may be received, and a preliminary compactor interaction plan established on the basis thereof, represented by way of example in FIG. 3. Once additional electronic data indicative of a subsequent compaction response associated with one or more subsequent compactor passes is received for a part or all of the cells of the work area, the compactor interaction plan may be updated. In particular, electronic control unit 30 may compare the electronic data associated with or indicative of a preliminary compaction response with the additional electronic data, and update the compactor interaction plan responsive to comparing the respective data sets. Electronic control unit 30 may be thought of as progressively refining a compactor interaction plan based on the most recent data available.

Figure 5:
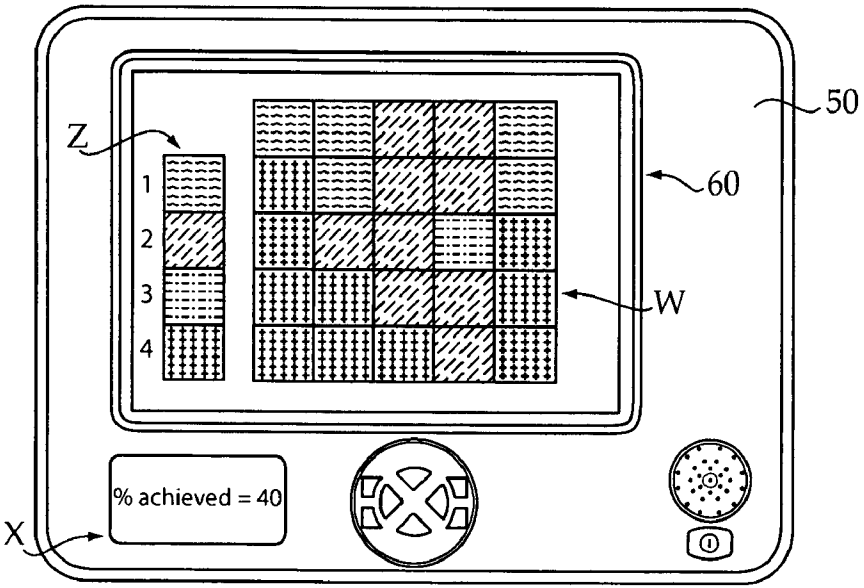
FIG. 5 is yet another hypothetical data display scenario utilizing the display of the machine system shown in FIG. 1.

Turning now to FIG. 5, there is shown work area W displayed on display screen 60 as it might appear after executing the compactor travel path $P_3$ shown in FIG. 4. It may be noted that 10 of the 25 cells of work area W have a compaction state corresponding to number 4 on scale Z. At this point, a compaction state of 4 has been achieved for approximately 40% of work area W. From the state illustrated in FIG. 5, compactor interaction may continue according to progressively updated compactor interaction plans, until compaction specifications are satisfied. For example, additional data may be received for subsequent passes, and the compactor interaction plan updated and executed until a compaction state of 4 for 90% of the work area is achieved.

INDUSTRIAL APPLICABILITY

Figure 6:
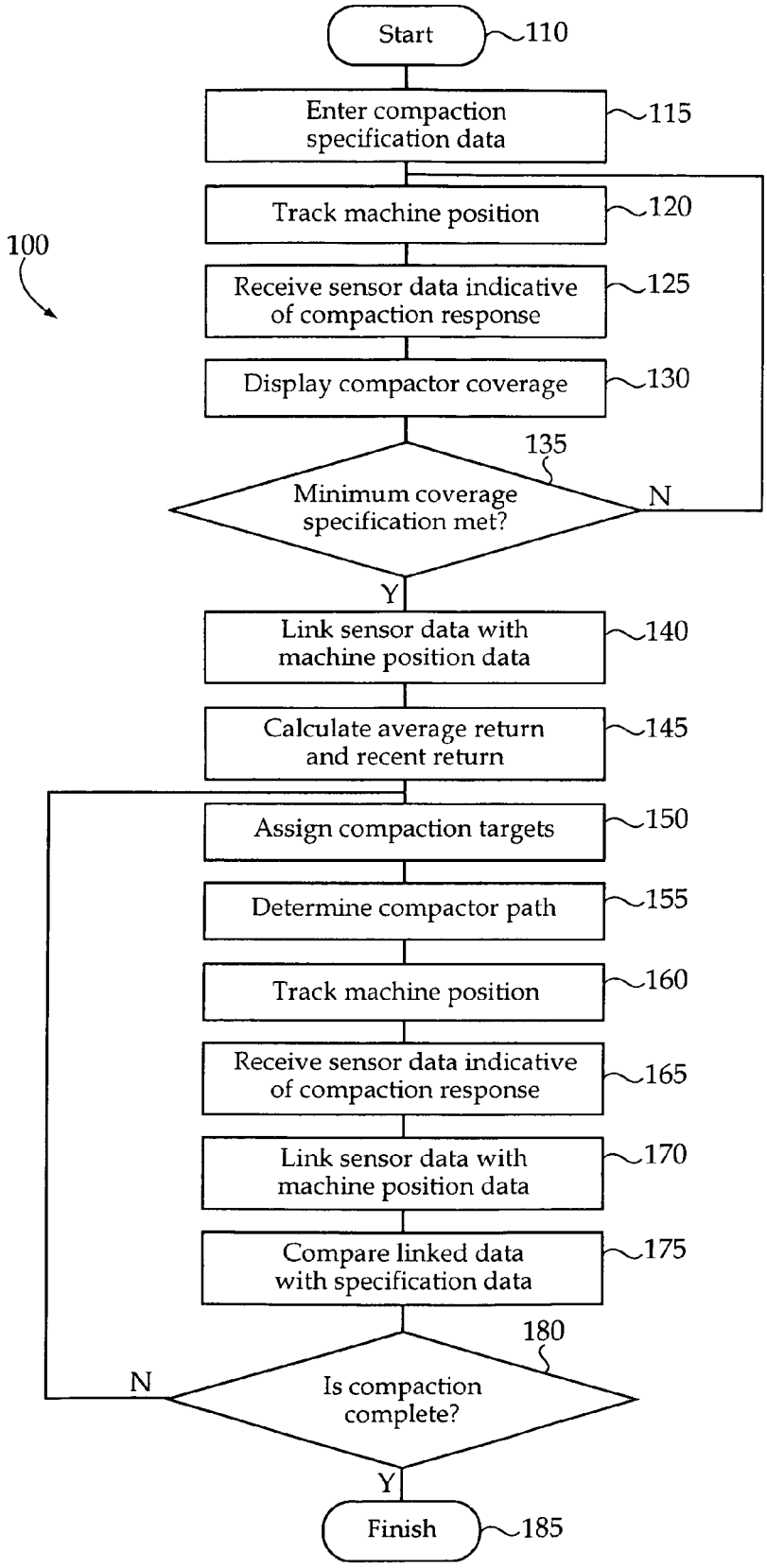
FIG. 6 is a flowchart illustrating an example control process according to one embodiment.

Referring to FIG. 6, there is shown a flowchart 100 illustrating an example control process according to the present disclosure. The process of flowchart 100 may begin at step 110, Start or initialization. From step 110, the process may proceed to step 115 to enter compaction specification data. Compaction specification data may be specified by Department of Transportation regulations, agreed upon by a contractor and customer, etc. It is contemplated that the compaction specifications may include many different parameters, such as compaction state parameters, compactor coverage parameters, density, and combinations of these and other parameters. From step 115, the process may proceed to step 120 to track machine position, for instance by receiving signals with receiver 24. From step 120, the process may proceed to step 125 wherein electronic control unit 30 receives electronic data such as sensor data from sensor 26 indicative of a varying compaction response among the different regions of the work area. Variance in compaction state of the cells in FIGS. 2-5 represents one example of a hypothetical varying compaction response. From step 125, the process may proceed to step 130 wherein electronic control unit 30 may output display signals to display 50 such that compactor coverage of the work area is displayed thereon. Examples such as coloring or shading cells of work area W are readily conceived. From step 130, the process may proceed to step 135 to query whether a minimum coverage specification has been met. It will be recalled that for most compacting work a coverage criterion will be specified, such that every region of a work area is covered at least once, at least twice, etc. If the minimum coverage specification is not met, the process may return to execute steps 120-135 again. If yes, the process may proceed ahead to step 140.

At step 140, electronic control unit 30 may link the sensor data with machine position data, such that the varying compaction response may be mapped to positions of compactor 10 at different locations in the work area. It will be recalled that the work area may be partitioned into cells, and each cell assigned a numerical value corresponding with a relative compaction thereof. Differences among these numerical values indicates a varying compaction response, and changes in the numerical values over time indicate a compaction response associated with a particular cell. Thus, linking the sensor data with location or position data may be understood as associating a numerical compaction state value with a numerical position value(s). From step 140, the process may proceed to step 145 where electronic control unit 30 may calculate an average return and a most recent return for each of the cells of the work area. In other words, in one embodiment electronic control unit 30 can calculate an average increase in relative compaction per each compactor pass for each cell of the work area. Electronic control unit 30 may also calculate the increase in relative compaction associated with the most recent pass of compactor 10 within each individual cell of the work area. Each of these quantities may be used in establishing a compactor interaction plan for further compacting of the work area. For example, certain areas which preliminarily responded relatively well to compactor interaction may not subsequently respond particularly well to compactor interaction, and it thus might be concluded that relative compaction of those areas is maxed out. Likewise, other areas which initially showed little increase in relative compaction per each compactor pass might be responding relatively better to subsequent compactor passes, and thus could be prioritized for subsequent treatment.

From step 145, the process may proceed to step 150 where electronic control unit 30 will assign different compaction targets to different regions of the work area. For instance, certain areas which have been covered the minimum number of times but respond relatively poorly to compactor interaction might be assigned a low compaction target. Other regions of the work area might be assigned a higher compaction target, where such other regions appear to be more amenable to compaction to an optimal compaction state.

From step 150, the process may proceed to step 155 to determine a compactor travel path. Determining a compactor travel path is one example of determining a compactor interaction plan, as described herein. From step 155, another round of interaction between compactor 10 and work area W may commence, via the travel path established in step 155 and the process may proceed to step 160 to again track machine position. From step 160, the process may proceed to step 165 to receive sensor data indicative of a varying compaction response. From step 165 the process may proceed to step 170 to link the sensor data with machine position data, establishing what compaction state or compaction response state is associated with which cell(s) within work area W. From step 175 the process may proceed to step 175 to compare the linked data with the compaction specification data. In other words, in step 175, electronic control unit 30 may compare actual compaction data, associated with position data, with a compaction specification. Thus, at step 175, it might be queried whether, for example, at least 90% of work area W is at a compaction state 3, and no more than 5% is at a compaction state 1, etc. From step 175 the process may proceed to step 180 to query whether compaction is complete. If no, the process may return to execute steps 155-175 again. If yes, the process may proceed to step 185 to Finish.

The present description is for illustrative purposes only, and should not be construed to narrow the breadth of the present disclosure in any way. Thus, those skilled in the art will appreciate that various modification might be made to the presently disclosed embodiments without departing from the full and fair scope and spirit of the present disclosure. For example, while the foregoing description emphasizes controlling operation of machine system 8 via commands or displayed suggestions such as compactor travel paths on display 50 to navigate compactor 10 within a work area, the present disclosure is not thereby limited. In other embodiments, rather than suggesting or commanding travel direction, compactor speed, vibratory output state, etc., might be planned via executing the compactor interaction planning algorithm. Thus, rather than commanding/suggesting specific travel paths $P_1$, $P_2$ and $P_3$, as described above, electronic control unit 30 might output display commands to display 50 such that a map of the work area indicates uniform coverage by compactor 10, but at a non-uniform vibratory output and speed. Areas responding poorly might be passed over quickly with a vibratory apparatus of compactor 10 turned off, while more promising areas could be worked more slowly, with vibration turned on. Other aspects, features, and advantages will be apparent upon the examination of the attached drawings and appended claims.

What is claimed is:

1. A method of operating a machine system for compacting a work area comprising the steps of:

receiving electronic data indicative of a varying compaction response of material within a work area;

linking the electronic data with location data for the work area; and assigning each one of at least two different compaction targets to a different region of the work area, in response to linking the electronic data with location data.

2. The method of claim 1 wherein the step of assigning further includes assigning at least one of, a compactor coverage target and a relative compaction target.

3. The method of claim 2 further comprising a step of inputting compaction specification criteria for the work area, wherein the step of assigning further includes a step of electronically reading the compaction specification criteria.

4. The method of claim 3 further comprising a step of establishing a compactor interaction plan for compacting the work area responsive to assigning each one of the at least two different compaction targets.

5. The method of claim 4 wherein the step of establishing a compactor interaction plan includes establishing a non-uniform compactor coverage plan.

6. The method of claim 4 further comprising a step of moving a compactor within the work area, wherein the step of receiving includes receiving the electronic data from a sensing system resident on the compactor during moving the compactor within the work area.

7. The method of claim 6 further comprising the steps of receiving the location data via a receiver resident on the compactor, and partitioning the work area into cells in response to the location data, wherein the step of linking further includes associating a compaction response value which is based on the electronic data with each one of the cells.

8. The method of claim 7 wherein the step of receiving includes receiving electronic data indicative of a preliminary compaction response associated with at least one preliminary compactor pass within each of the cells, the method further comprising the steps of receiving additional electronic data indicative of a subsequent compaction response associated with at least one subsequent compactor pass within a subset of the cells, and comparing the electronic data indicative of the preliminary compaction response with the additional electronic data.

9. The method of claim 8 further comprising a step of updating the compactor interaction plan in response to the step of comparing.

10. The method of claim 4 further comprising a step of outputting a compactor navigation command which is based at least in part on the compactor interaction plan.

11. The method of claim 4 wherein the step of receiving includes receiving electronic data indicative of a preliminary compaction response associated with at least one preliminary compactor pass within a region of the work area, the method further comprising the steps of receiving additional electronic data indicative of a subsequent compaction response associated with at least one subsequent compactor pass within the region, and updating the compactor interaction plan responsive to the additional electronic data.

12. A machine system comprising:

a compactor having a frame and at least one compacting element coupled with the frame;

a sensing system configured to output signals including electronic data indicative of a varying response of material within a work area to interaction of the compactor therewith; and an electronic control unit coupled with the sensing system and linking the electronic data with location data for the work area, the electronic control unit further assigning each one of at least two different compaction targets to different regions of the work area responsive to linking the electronic data with the location data.

13. The machine system of claim 12 further comprising a computer readable memory configured for storing compaction specification criteria thereon, the electronic control unit being coupled with the computer readable memory and further configured to assign each one of the at least two different compaction targets to the different regions of the work area at least in part via reading the compaction specification criteria.

14. The machine system of claim 13 wherein the computer readable memory stores a compactor interaction planning algorithm, and wherein the electronic control unit is configured via executing the compactor interaction planning algorithm to determine a compactor interaction plan for compacting the work area responsive to assigning the at least two different compaction targets and further configured to output a compactor control command according to the compactor interaction plan.

15. The machine system of claim 14 further comprising a display controllably coupled with the electronic control unit and configured to display a map of the work area which includes at least one of, a compactor coverage of the work area, a compaction response of material within the work area and a planned compactor travel path within the work area, and wherein each of the display, the electronic control unit, the computer readable memory and the sensing system are resident on the compactor.

16. The machine system of claim 15 wherein the electronic control unit is configured to receive additional electronic data from the sensing system which is indicative of a subsequent response of material within the work area to subsequent interaction of the compactor therewith and responsively output a display updating signal to update the map of the work area based at least in part on the additional electronic data.

17. A machine control system comprising an electronic control unit configured to receive signals including electronic data indicative of a varying response of material within a work area to interaction of a compactor therewith, the electronic control unit further receiving location data for the work area and linking the electronic data with the location data and responsively assigning each one of at least two different compaction targets to different regions of the work area.

18. The machine control system of claim 17 further comprising a computer readable memory coupled with the electronic control unit and an input device configured to input compaction specification criteria for storing on the computer readable memory, the electronic control unit being configured via reading the compaction specification criteria to assign at least one of a compactor coverage target and a relative compaction target to each of the different regions of the work area.

19. The machine control system of claim 18 further comprising a sensing system coupled with the electronic control unit and having at least one sensor configured to sense a parameter indicative of energy transfer between the compactor and material within the work area, and the sensing system being configured to output the signals indicative of the varying response of material to interaction of the compactor therewith.

20. The machine control system of claim 19 wherein the computer readable memory stores a compactor interaction planning algorithm, and wherein the electronic control unit is configured via executing the compactor interaction planning algorithm to determine a compactor interaction plan for compacting the work area responsive to assigning the at least two different compaction targets, and further configured to output a compactor control command according to the compactor interaction plan.

* * * * *